US007942357B2

(12) United States Patent
Dallimore et al.

(10) Patent No.: US 7,942,357 B2
(45) Date of Patent: May 17, 2011

(54) WEAR PART FOR A VSI-CRUSHER, AND A METHOD OF REDUCING THE WEAR ON THE ROTOR OF SUCH A CRUSHER

(75) Inventors: Rowan Dallimore, Bath (GB); George Fensome, Bristol (GB); Knut Kjaerran, Svedala (SE)

(73) Assignee: Sandvik Intellectual Property AB, Sandviken (SE)

( * ) Notice: Subject to any disclaimer, the term of this patent is extended or adjusted under 35 U.S.C. 154(b) by 160 days.

(21) Appl. No.: 12/081,972

(22) Filed: Apr. 24, 2008

(65) Prior Publication Data

US 2008/0265075 A1 Oct. 30, 2008

(30) Foreign Application Priority Data

Apr. 25, 2007 (SE) ..... 0700983

(51) Int. Cl.
*B02C 19/00* (2006.01)

(52) U.S. Cl. ..... 241/275; 241/300

(58) Field of Classification Search ..... 241/275, 241/300

See application file for complete search history.

(56) References Cited

U.S. PATENT DOCUMENTS

| | | | | |
|---|---|---|---|---|
| 3,895,982 | A * | 7/1975 | Persson | 156/71 |
| 4,690,341 | A | 9/1987 | Hise et al. | |
| 4,787,564 | A | 11/1988 | Tucker | |
| 6,554,215 | B1 | 4/2003 | Schultz et al. | |
| 2005/0269438 | A1 | 12/2005 | Dallimore | |

FOREIGN PATENT DOCUMENTS

| | | |
|---|---|---|
| WO | 2004/020100 | 3/2004 |

OTHER PUBLICATIONS

International Search Report mailed Jun. 18, 2008 issued in PCT Application No. SE/2008/000213.

* cited by examiner

*Primary Examiner* — Mark Rosenbaum
(74) *Attorney, Agent, or Firm* — Drinker Biddle & Reath LLP

(57) ABSTRACT

A wear part for protecting a vertical rotor wall of a rotor of a VSI-crusher includes a wear body having a wear surface adapted for contacting abrasive particles. The wear surface is provided with at least one ridge extending over at least a portion of the wear surface. At least a portion of the length of the ridge is, when the wear part has been mounted to the vertical rotor wall, inclined in relation to a horizontal plane.

15 Claims, 9 Drawing Sheets

WEAR PART FOR A VSI-CRUSHER, AND A METHOD OF REDUCING THE WEAR ON THE ROTOR OF SUCH A CRUSHER

FIELD OF THE INVENTION

The present invention relates to a wear part for protecting a vertical rotor wall of a rotor of a VSI-crusher, the rotor having a horizontal upper disc, and a horizontal lower disc, the vertical rotor wall connecting the horizontal upper disc to the horizontal lower disc. The present invention also relates to a method of decreasing the wear rate of a rotor of a VSI-crusher.

BACKGROUND OF THE INVENTION

Vertical shaft impact crushers (VSI-crushers) are used in many applications for crushing hard material, such as rocks, ore etc. U.S. Pat. No. 4,690,341 describes one example of a VSI-crusher. A-VSI-crusher comprises a housing and a horizontal rotor located inside the housing. Material that is to be crushed is fed into the rotor via an opening in the top thereof. With the aid of centrifugal force, the rotating rotor ejects the material against the wall of the housing. On impact with the wall of the housing, the material is crushed to a desired size. The housing wall could be provided with anvils or have a bed of retained material against which the accelerated material is crushed.

The rotor of a VSI-crusher usually has a horizontal upper disc and a horizontal lower disc. The upper and lower discs are connected with a vertical rotor wall. The upper disc has an aperture for feeding material into the rotor. The material lands on the lower disc and is then thrown out of the rotor via openings in the rotor wall. The vertical rotor wall is provided with various replaceable wear parts of a hard material, such as a hard metal or a ceramic, to protect it from wear caused by the material leaving the rotor at a high speed. The rotor of U.S. Pat. No. 4,690,341 is provided with a number of wear parts in the form of overlapping dove tailed wear castings to protect the vertical rotor wall from abrasive particles moving at high speed within the housing of the crusher. Other rotor types, such as that described in WO 2004/020100, have wear parts positioned on specific places of the vertical rotor wall.

When the wear parts protecting the vertical rotor wall have become worn out they must be replaced. Replacement of the wear parts requires the VSI-crusher to be shut down for a considerable time for maintenance.

SUMMARY

It is an object of the present invention to provide a wear part for a vertical rotor wall of a rotor of a VSI-crusher, the wear part having a longer life than the wear parts of the prior art, such that shutting down the VSI-crusher for maintenance can be made less often.

This object is achieved with a wear part for protecting a vertical rotor wall of a rotor of a VSI-crusher, the rotor having a horizontal upper disc, and a horizontal lower disc, the vertical rotor wall connecting the horizontal upper disc to the horizontal lower disc, the wear part being wherein the wear part comprises a wear body having a wear surface adapted for contacting abrasive particles, the wear surface being provided with at least one ridge extending over at least a portion of the wear surface, at least a portion of the length of the ridge being, when the wear part has been mounted to the vertical rotor wall, inclined in relation to a horizontal plane.

An advantage with this wear part is that it is operative, when mounted on the rotor spinning around inside the housing of the VSI-crusher, to deflect dust laden horizontal low pressure air streams, that circulate adjacent to the rotor, from the horizontal plane. Such deflection has the effect that the abrasive properties of such low pressure air streams is substantially reduced, resulting in an increased life of the rotor and of the wear part as such. Thus, shutting down the VSI-crusher for maintenance can be effected less often.

According to one preferred embodiment the wear part is provided with at least two ridges. An advantage of this embodiment is that the wear part can provide a more efficient deflection of the dust laden horizontal low pressure air streams from the horizontal plane. Still more preferably, the at least two ridges extend in different directions, at least for a portion of their respective lengths. An advantage of this embodiment is that two ridges extending in different directions are very efficient in disturbing the flow pattern of the horizontal low pressure air streams circulating adjacent to the rotor, since such air streams are deflected in two different directions. Such disturbance of the flow pattern has proven very efficient in decreasing the abrasive capacity of the dust laden horizontal low pressure air streams.

According to one preferred embodiment the at least one ridge extends from a shoulder formed on the wear surface. An advantage of this embodiment is that the shoulder may protect the ridge from impact of larger objects, such as rocks, bouncing back at the rotor from the wall of the housing. The shoulder formed on the wear surface of the wear part will thus mainly serve for protecting the vertical rotor wall from impact by larger objects, and the at least one ridge will serve to deflect dust laden low pressure air streams circulating adjacent to the rotor, such that the vertical rotor wall is protected from abrasive wear of particles entrained by such air streams.

According to one preferred embodiment the at least one ridge has the form of an arc, as seen from the top of the ridge, along at least a portion of its length. An arc has proven to be an efficient way of deflecting horizontal low pressure air streams.

According to one preferred embodiment the at least one ridge is straight, as seen from the top of the ridge, along at least a portion of its length. An advantage of a straight ridge is that any wear occurring on the ridge will often be quite even, such that the ridge is not early worn down at any specific position. According to one preferred embodiment the angle between such a straight ridge and the horizontal plane, when the wear part is mounted to the rotor, is 20 to 70°, resulting in a similar deflection, locally, of the low pressure air streams.

In accordance with one preferred embodiment the wear surface is provided with a curvature, the at least one ridge following the curvature of the wear surface. An advantage of this embodiment is that the wear surface provides a good support for the ridge. Thereby the risk that the ridge is damaged by large objects bouncing back at the rotor from the wall of the housing is decreased. Furthermore, a wear surface with a curvature usually conforms better to the air streams, such that excessive wear of any portions of the wear surface can be avoided.

Preferably the at least one ridge extends, for at least a portion of its length, to a height of at least 3 mm from the wear surface. It has been found that, if no portion of the ridge extends more than 3 mm from the wear surface, the ridge will be less efficient in deflecting the low pressure air streams. Preferably the ridge does not extend to a height of more than about 15 mm from the wear surface. If a portion of the ridge extends to a height of more than 15 mm from the wear surface, there is an increased risk that the ridge might be damaged by objects bouncing back at the rotor from the wall of the housing.

Preferably, the at least one ridge has a width, for at least a portion of its length, of 4-20 mm. A ridge with a width of less than 4 mm would be very sensitive to wear and to objects, such as rocks, bouncing back at the rotor. A ridge with a width of more than 20 mm would be less efficient in deflecting air streams, since less of the wear surface would be available for the flowing of such air streams. Hence, a considerable fraction of the air streams would flow over such a wide ridge and cause wear on the ridge instead of being deflected by it.

Preferably, the at least one ridge has a total length of 20 to 200 mm. A ridge width a total length of at least 20 mm is preferable for to obtain an efficient deflection of the horizontal air streams. A length of more than about 200 mm increases the production costs of the wear part without providing substantial further benefits for the deflection of the air streams.

According to one preferred embodiment, the wear part is a tip holder including a wear body which holds a wear tip, the at least one ridge being located on the wear surface formed on the wear body, and extending generally from the location of the wear tip. The wear tip is usually located at an opening in the vertical rotor wall, through which opening the material to be crushed and high pressure air is ejected. The tip holder, and in particular its wear body, is subjected to wear caused both by abrasive particles contained in the flow of material ejected through the opening, and to wear caused by the horizontal dust laden low pressure air streams circulating adjacent to the rotor. By locating at least one ridge on a wear surface formed on the wear body, a tip holder with a substantially increased life length is obtained.

According to another preferred embodiment the wear part is a cavity wear plate adapted for protecting a cavity formed in the vertical rotor wall, the wear surface comprising a shoulder being adapted for being located adjacent to the periphery of the rotor, the at least one ridge extending from the shoulder in a direction generally towards the center of the rotor, when the wear part has been mounted to the vertical rotor wall. The cavity formed in the vertical rotor wall is subjected to wear caused both by rocks bouncing back from the housing of the rotor, and by horizontal dust laden low pressure air streams circulating adjacent to the rotor. Such air streams may cause local air streams inside the cavity of the vertical rotor wall. The aforementioned cavity wear plate is provided with a shoulder at the periphery for protecting the cavity from objects bouncing back from the housing wall, and with at least one ridge for deflecting any air streams, also such air streams that are formed locally inside the cavity formed in the vertical rotor wall.

A further object of the present invention is to provide a method of reducing the wear rate of a rotor of a VSI-crusher.

This object is achieved by means of a method of decreasing the wear rate of a rotor of a VSI-crusher, wherein a vertical rotor wall, which connects a horizontal upper disc of the rotor to a horizontal lower disc of the rotor, is provided with at least one wear surface, which is provided with at least one ridge, which is, for at least a portion of its length, inclined in relation to a horizontal plane, the at least one ridge breaking up, during rotation of the rotor, horizontal dust laden air streams, which circulate around the rotor adjacent to the wear surface, by deflecting such air streams from the horizontal plane.

An advantage of this method is that it serves to decrease the abrasive properties of the horizontal dust laden air streams, such that the VSI-crusher can operate for longer periods of time between maintenance stops.

According to one preferred embodiment, the deflection of the horizontal dust laden air streams from the horizontal plane by means of the at least one ridge corresponds to a deflection, locally, of 20-70°. The deflection should be at least 20°, since a deflection of less than 20° is often too little to obtain an efficient decrease in the abrasive properties of the horizontal dust laden air streams. A deflection of more than about 70° is seldom necessary for an efficient deflection of the air streams, and may cause increased wear to the ridge itself.

These and other aspects of the invention will be apparent from and elucidated with reference to the claims and the embodiments described hereinafter.

BRIEF DESCRIPTION OF THE DRAWINGS

The invention will hereafter be described in more detail and with reference to the appended drawings.

DETAILED DESCRIPTION OF THE PREFERRED EMBODIMENTS

Figure 1:
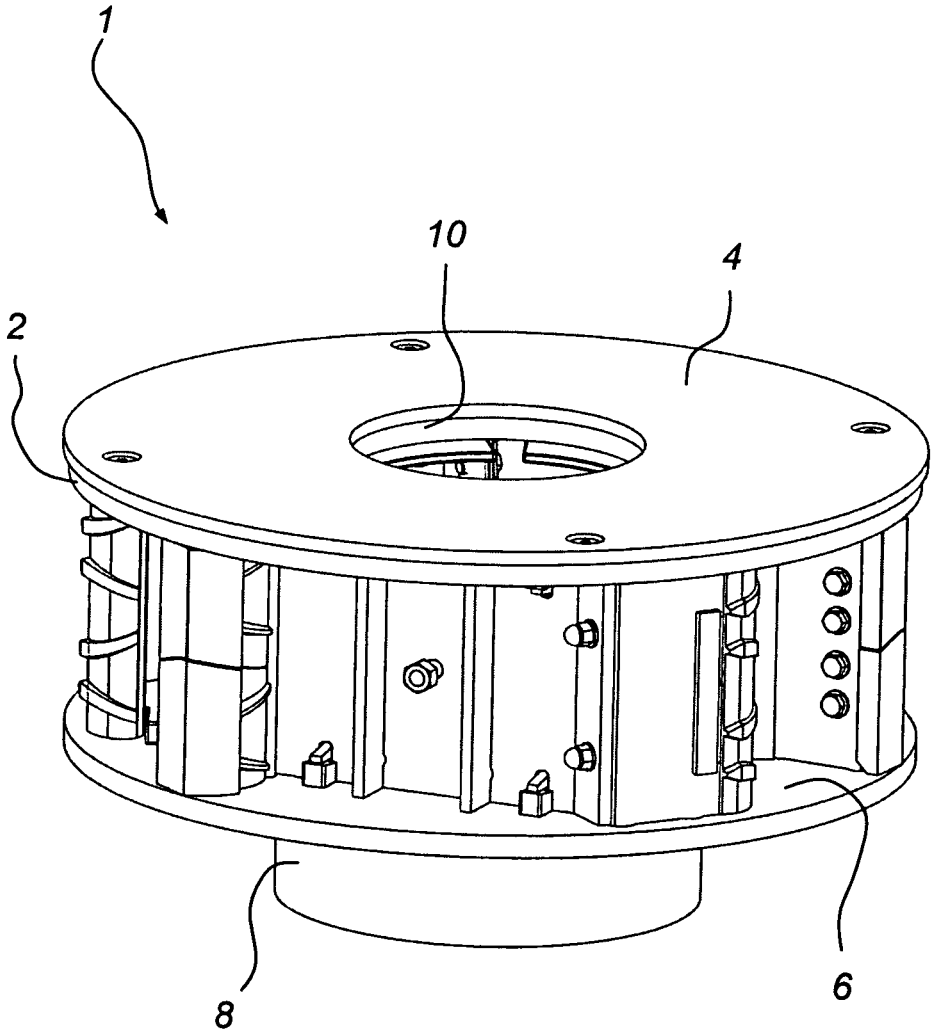
FIG. 1 is a three-dimensional view and shows a rotor for a VSI-crusher.

FIG. 1 shows a rotor 1 for use in a Vertical Shaft Impact Crusher, i.e., a VSI-crusher. The rotor 1 has a roof in the form of a horizontal upper disc 2 having a top wear plate 4, and a floor in the form of a horizontal lower disc 6. The lower disc 6 has a hub 8, which is welded to the disc 6. The hub 8 is to be connected to a shaft (not shown) for rotating the rotor 1 inside the housing of a VSI-crusher. The upper disc 2 has a central aperture 10 through which material to be crushed can be fed into the rotor 1. The upper disc 2 is protected from rocks impacting the rotor 1 from above by the top wear plate 4.

Figure 2:
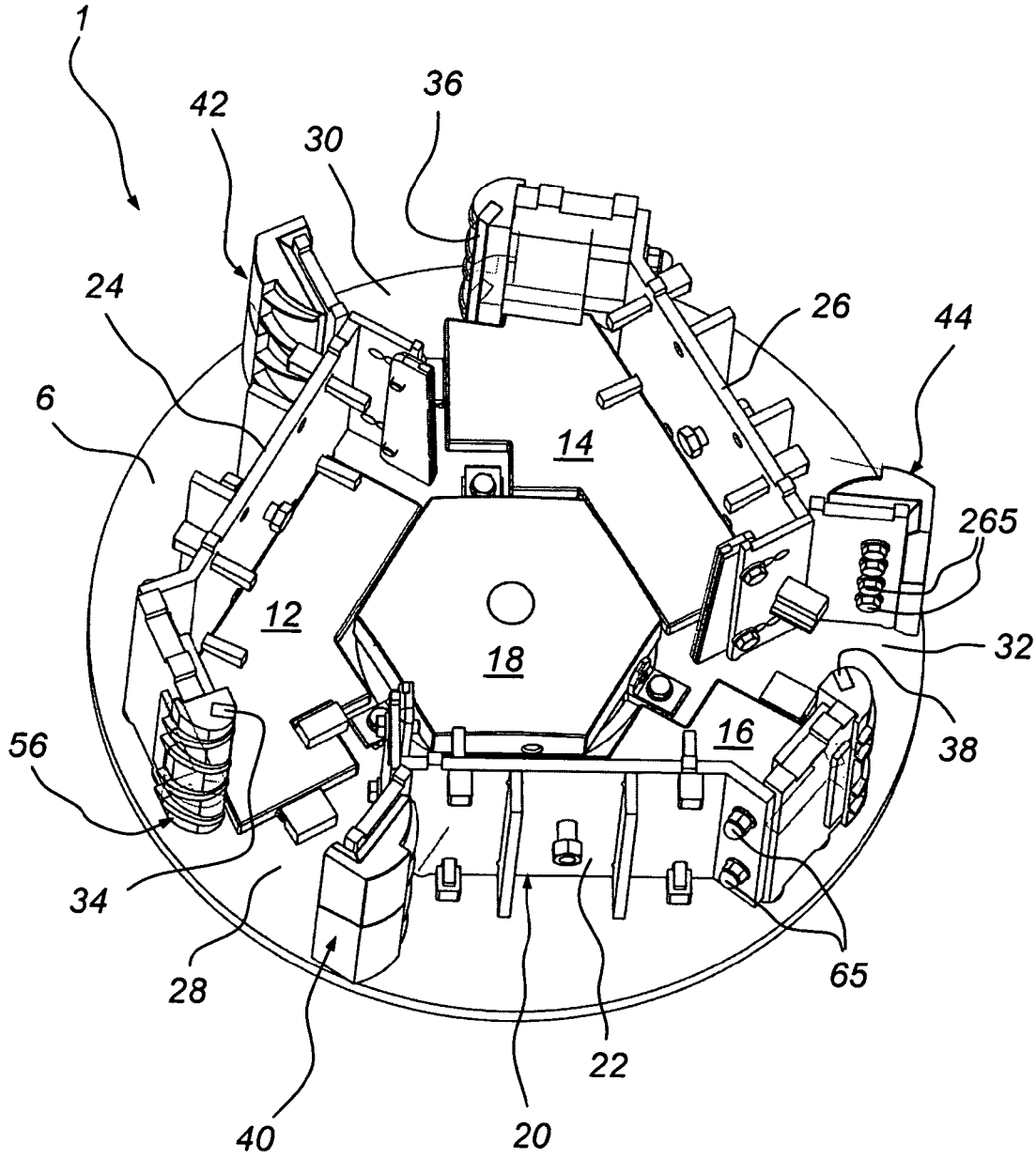
FIG. 2 is a three-dimensional view and shows the rotor of FIG. 1 with the upper disc removed.

As is better shown in FIG. 2, the lower disc 6 is protected from wear by three lower wear plates 12, 14 and 16. A distributor plate 18 is fastened to the center of the lower disc 6. The distributor plate 18 distributes the material that is fed via the aperture 10 in the upper disc 2 and protects the lower disc 6 from wear and impact damages caused by the material fed via the aperture 10.

The upper and lower discs 2, 6 are separated by and held together by a vertical rotor wall 20 which is separated into three wall segments 22, 24 and 26. The gaps between the wall segments 22, 24, 26 define outflow openings 28, 30, 32, through which material may be ejected against a housing wall. At each outflow opening 28, 30, 32 the respective wall segment 22, 24, 26 is protected from wear by a wear tip 34, 36, 38 located at the trailing edge of the respective wall segment 22, 24, 26. Each wear tip 34, 36, 38 is mounted in a tip holder, which will be described further below. Each wall segment 22, 24, 26 is provided with a pair 40, 42, 44 of cavity wear plates, which will be described in more detail below. The pairs 40, 42, 44 of cavity wear plates protects the rotor 1 and in particular the wear tips 34, 36, 38 from material rebounding from the housing wall and from ejected material and airborne fine dust spinning around the rotor 1.

Figure 3:
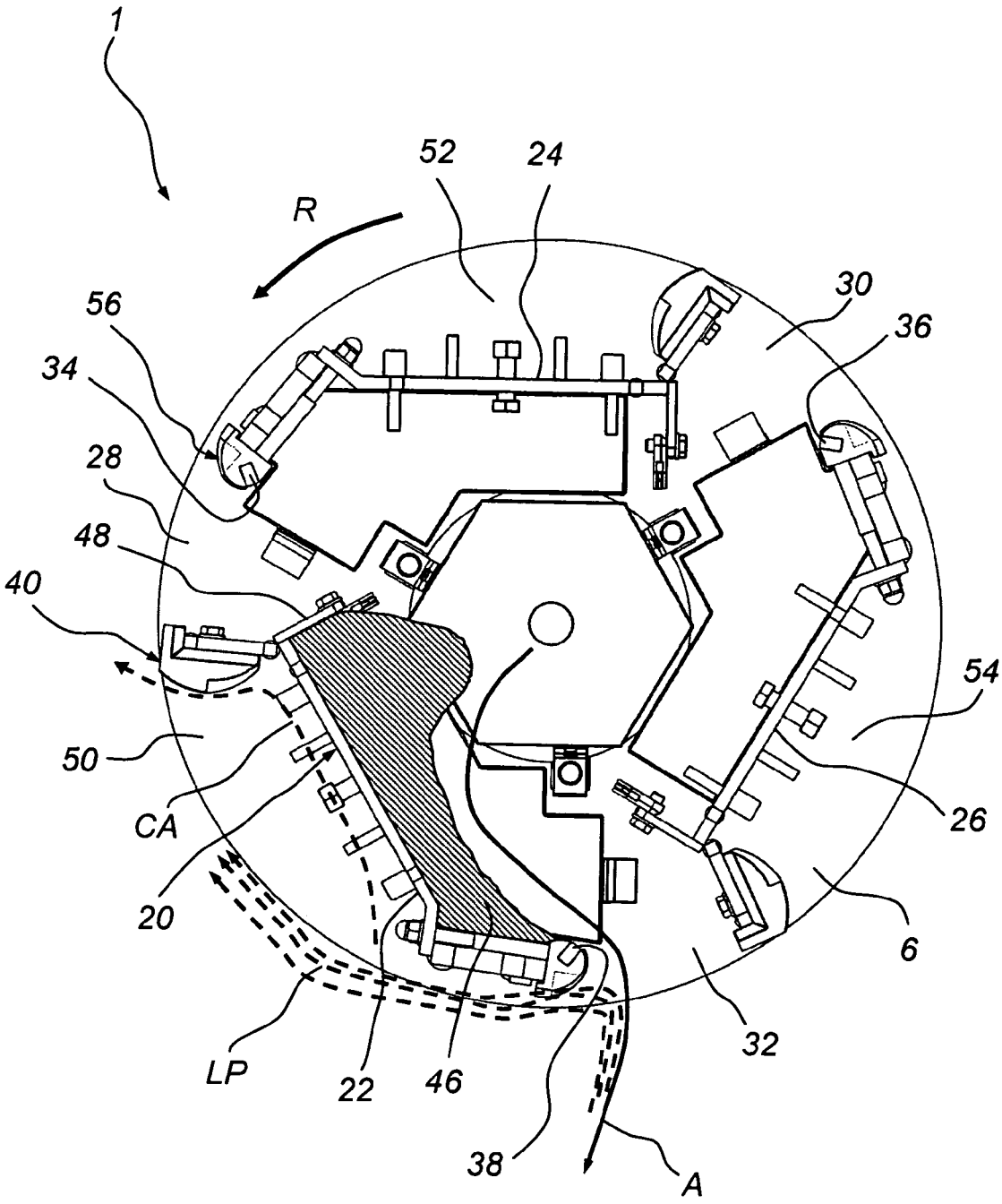
FIG. 3 shows the view of FIG. 2 as seen from above in a two dimensional perspective.

FIG. 3 illustrates the rotor 1 as seen from above and in operation. The upper disc 2 and the top wear plate 4 are not shown in FIG. 3 for reasons of clarity. The arrow R indicates the rotational direction of the rotor 1 during operation of the VSI-crusher. During operation of the rotor 1 a bed of material 46 is built up inside the rotor 1 against each of the three wall segments 22, 24, 26. In FIG. 3 only the bed 46 located adjacent to the wall segment 22 is shown. The bed 46, which consists of material that has been fed to the rotor 1 and then has been trapped inside it, extends from a rear support plate 48 to the wear tip 38. The bed 46 protects the wall segment 22 and the wear tip 38 from wear and provides a proper direction to the ejected material. The arrow A describes a typical passage of a piece of rock fed to the rotor 1 via the central aperture 10 and ejected via the outflow opening 32.

In operation, the rotor 1 will have a function that resembles that of a centrifugal pump. The rotor 1 "pumps" rock and high pressure dust laden air through the outflow openings 28, 30, 32, in a direction which is indicated by the arrow A of FIG. 3. Horizontal low pressure air streams are formed on either sides of the high pressure dust laden air. It would seem, from practical experiences, that dust is "sucked" into these low pressure air streams. The horizontal dust laden low pressure air streams, which are indicated by dashed arrows LP in FIG. 3, are thus drawn towards the rotor 1, due to the outflow of high pressure air and rock along the arrow A. Due to the rotation of the rotor 1, such horizontal dust laden low pressure air streams LP are laminated around the rotor 1. It is clear from FIG. 3 that the flow direction of the low pressure air streams LP is opposite to the direction R of the rotation of the rotor 1. The dust laden low pressure air streams spin around the rotor 1 and causes wear on the wall segments 22, 24, 26, the lower disc 4, the pairs 40, 42, 44 of cavity wear plates, the tip holders holding the wear tips 34, 36, 38, etc. The dust laden low pressure air streams may even flow into cavities 50, 52, 54 formed in the vertical rotor wall 20. Such a dust laden low pressure air stream flowing into the cavity 50 is denoted CA in FIG. 3. As will be described hereinafter wear plates are provided which serve to minimize the wear caused by such dust laden low pressure air streams LP and CA.

Figure 4A:
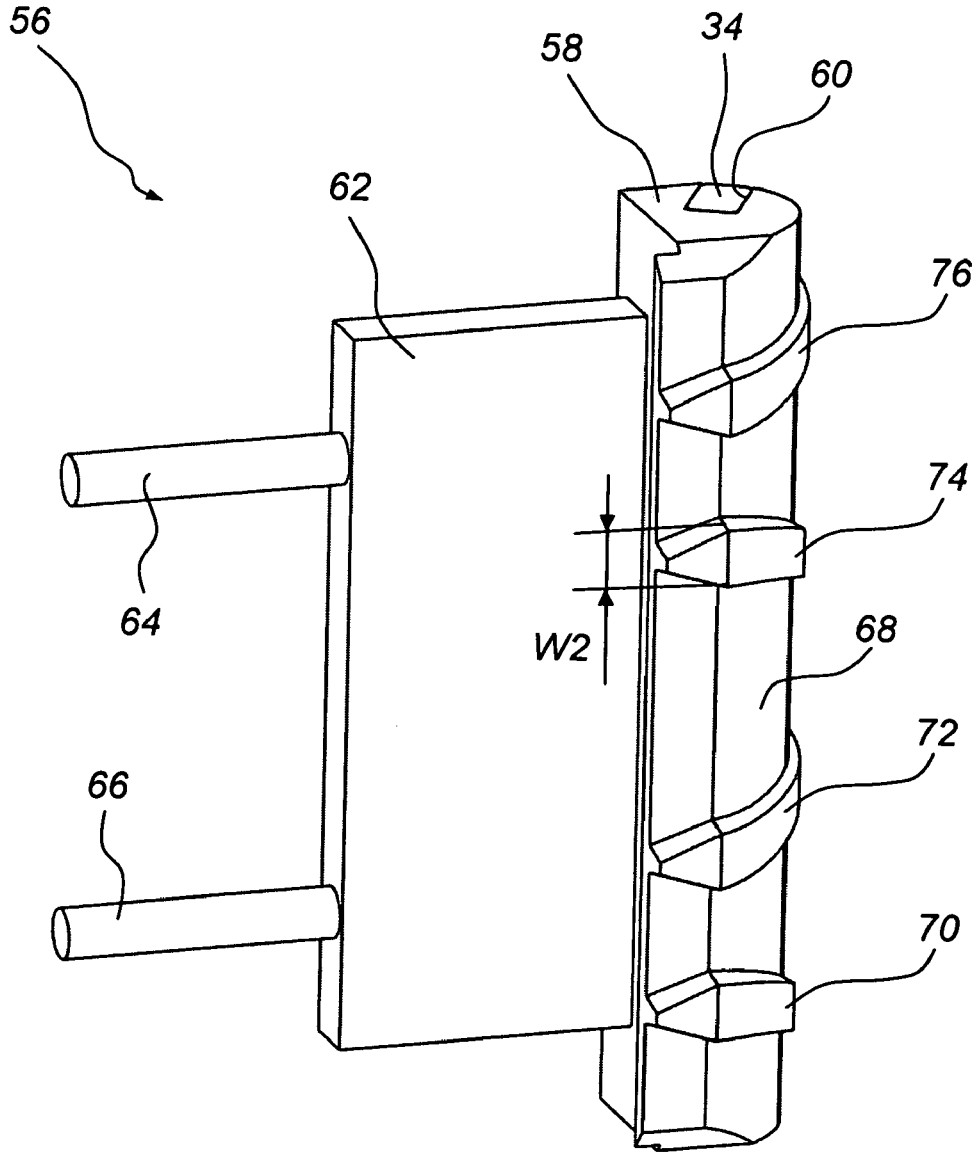
FIG. 4*a* is a three-dimensional view of a wear tip and a tip holder according to a first embodiment.
Figure 4B:
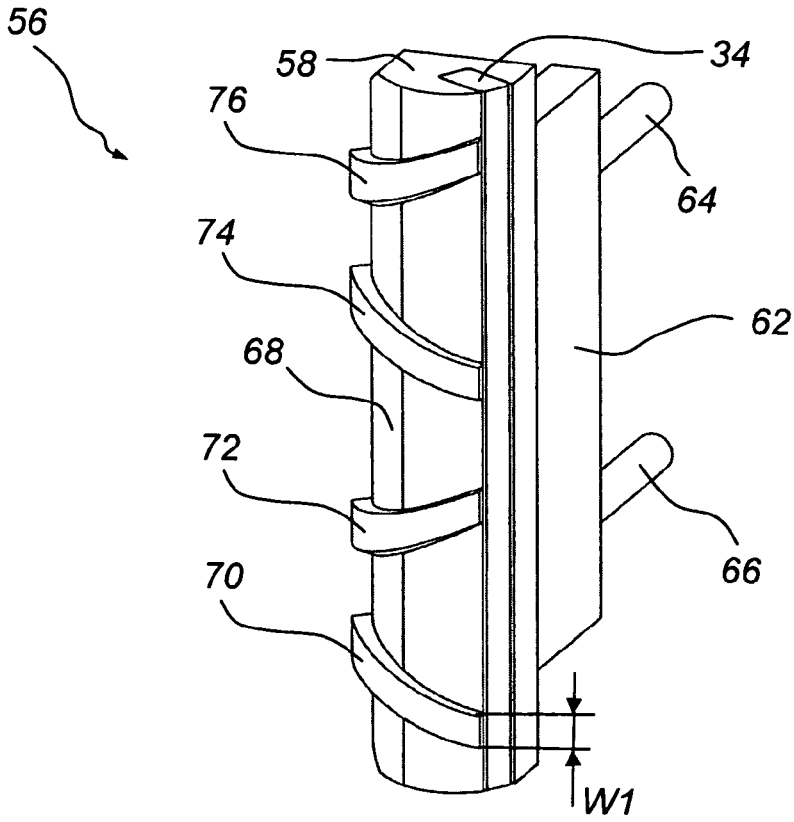
FIG. 4*b* is a further three-dimensional view of the wear tip and the tip holder of FIG. 4*a*.
Figure 4C:
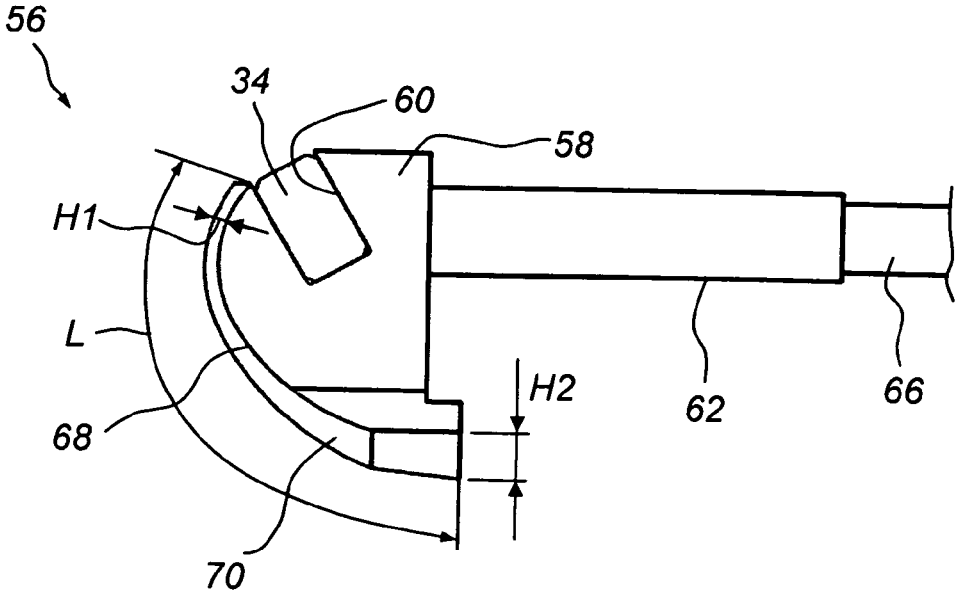
FIG. 4*c* is a top view of the wear tip and the tip holder of FIG. 4*a*.

FIG. 4*a*, 4*b* and 4*c* illustrate a first embodiment of a wear part in the form of a tip holder 56. The tip holder 56 has a wear body 58 which has a longitudinal recess 60 in which the wear tip 34 is located. The wear tip 34 may be welded or glued to the wear body 58. A holding plate 62, which is a flat rectangular plate, is attached to the wear body 58. Two round, threaded bars 64, 66 are attached to one end of the holding plate 62. By means of these two bars 64, 66 the tip holder 56 can be mounted to the wall segment 24 by means of nuts 65, shown in FIG. 2, for instance in the manner which has been described in more detail in WO 2004/020100 A1, see for instance FIG. 6 and 7 of that document.

Returning to FIG. 4*a*, 4*b* and 4*c*, the wear body 58 has a wear surface 68 which is located at the opposite side of the wear body 58 compared to the holding plate 62. The wear surface 68 is adapted for contacting abrasive particles and dust contained in the dust laden low pressure air stream LP circulating around the rotor 1, as illustrated in FIG. 3. When mounted on the rotor 1, the wear surface 68 will constitute the outer surface of the tip holder 56. The wear surface 68 is provided with four ridges 70, 72, 74, 76. The ridges 70-76 extend from the tip 34 and over the wear surface 68, generally in the same direction as the direction of the dust laden low pressure air stream LP. FIG. 4*b* clearly illustrates that the ridges 70-76 are not parallel to each other, but extend in different directions. Ridges 70 and 72 have the shape of arcs, as seen from the top of the respective ridge, and extend towards each other as seen from the tip 34, and ridges 74 and 76 have the shape of arcs and extend towards each other. From FIG. 4*c* it is clear that the wear surface 68 has a curvature and that the ridge 70 follows the curvature of the wear surface 68.

As is illustrated in FIG. 4*c*, the ridge 70 has, adjacent to the wear tip 34, a first height H1 above the wear surface 68. The ridge 70 has a second height H2 above the wear surface 68 at the opposite end of the ridge 70, i.e. adjacent to the holding plate 62. The height H1 is typically 3 mm, and the height H2 is typically 8 mm. The total length L of the ridge 70 is 70 mm. Furthermore, and as is best illustrated in FIG. 4*b*, the ridge 70 has a first width W1 adjacent to the wear tip 34. The first width W1 is about 10 mm. As is best shown in FIG. 4*a* the ridge 70 has a second width W2 at its widest portion, close to the holding plate 62. The second width W2 is about 15 mm.

Figure 5A:
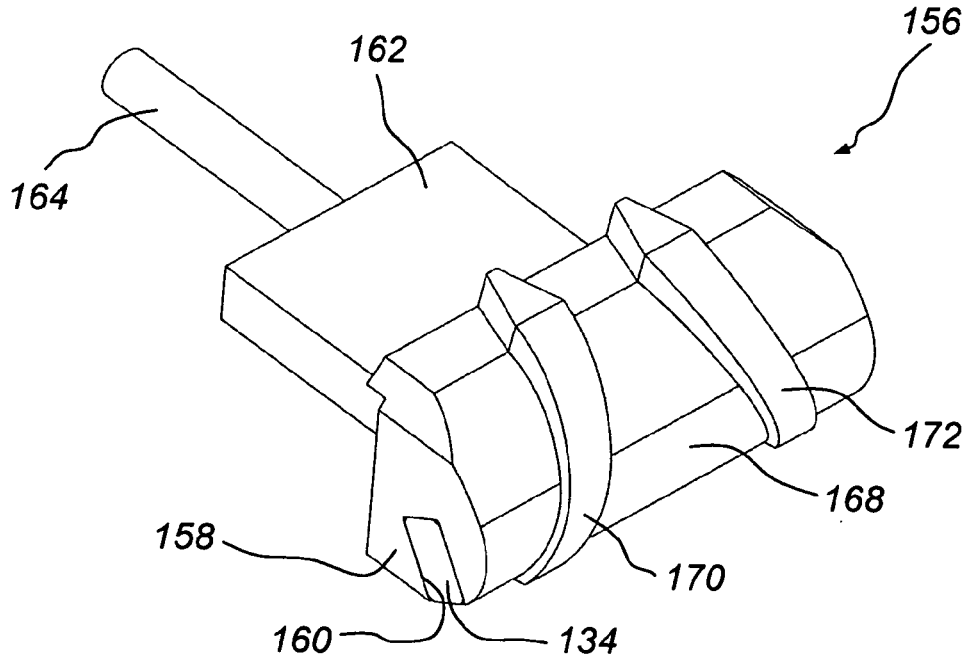
FIG. 5*a* is a three-dimensional view of a wear tip and a tip holder according to a second embodiment.
Figure 5B:
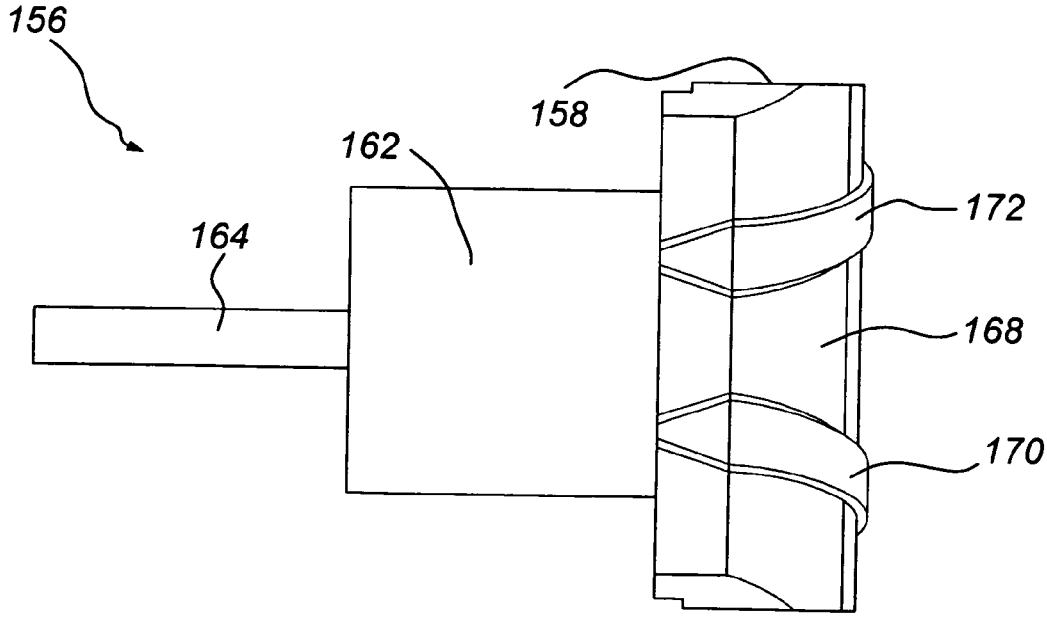
FIG. 5*b* is a side view of the wear tip and the tip holder of FIG. 5*a*.

FIG. 5*a* and 5*b* illustrate a second embodiment of a wear part in the form of a tip holder 156. The tip holder 156 has a wear body 158 which has a longitudinal recess 160 in which a wear tip 134 is located. A holding plate 162 is attached to the wear body 158. A round, threaded bar 164 is attached to one end of the holding plate 162. By means of this bar 164 the tip holder 156 can be mounted, optionally together with further tip holders of the same kind, to the wall segment 24, for instance in the manner which has been described in more detail in WO 2004/020100 A1, see for instance FIG. 5 and 6 of that document.

Returning to FIG. 5*a* and 5*b*, the wear body 158 has a wear surface 168 which is similar to the wear surface 68 described hereinbefore. The wear surface 168 is provided with two ridges 170, 172. The ridges 170, 172 extend from the wear tip 134 and over the wear surface 168, generally in the same direction as the direction of the dust laden low pressure air stream LP. FIG. 5*b* clearly illustrates that the ridges 170 and 172 have the shape of arcs, as seen from the top of the respective ridge, and extend towards each other, as seen from the wear tip 134. The ridges 170, 172 have similar dimensions as the ridges 70-76 of the tip holder 56.

Figure 6:
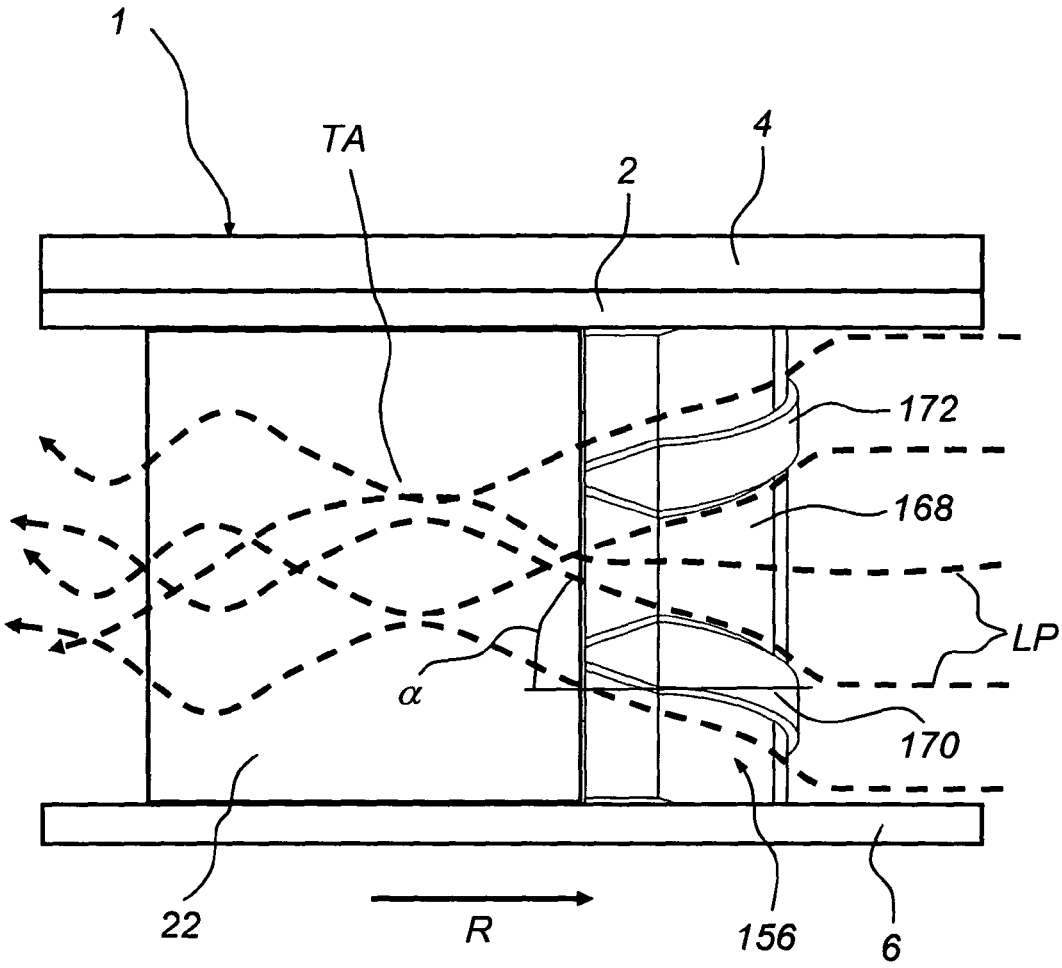
FIG. 6 is a schematic side view of the rotor and the tip holder, and illustrates the function of the tip holder.

FIG. 6 is a side view and illustrates schematically the principal function of the tip holder 156. The tip holder 56 works in a similar manner, but with four ridges instead of two. In FIG. 6, the tip holder 156 is shown as located at the wall segment 22 between the upper and lower discs 2, 6 of the rotor 1. The rotor 1 rotates in the direction indicated by an arrow R. As is indicated in FIG. 6, the horizontal dust laden low pressure air streams LP have a laminar flow characteristic upstream of the tip holder 156. When the low pressure air streams LP reach the tip holder 156 they come into contact with the wear surface 168 and start to flow along the wear surface 168. As can be seen from FIG. 6, at least a portion of the length of each ridge 170, 172 is, when the tip holder 156 has been mounted to the wall segment 22, inclined in relation to a horizontal plane. The ridge 170 is, at its central portion, inclined about 45° to the horizontal plane, as seen in FIG. 6, such that the central portion of the low pressure air streams LP will be subjected to a deflection, locally, at an angle $\alpha$ of about 45°. The ridges 170, 172 extending on the wear surface 168 will shrink the area available for the central portion of the low pressure air streams LP, such that the central portion of the low pressure air streams LP is squeezed between the two ridges 170, 172. Such squeezing will cause the central portion of the low pressure air streams LP to form an irregular turbulent flow, as shown in FIG. 6, downstream of the tip holder 156. The thereby formed turbulent flow area TA, shown in FIG. 6, is much less prone to causing wear than the laminar low pressure air streams LP upstream of the tip holder 156. Hence, the ridges 170, 172 serve to break up the laminar characteristic of the low pressure air streams LP, such that their wearing characteristics are reduced. Furthermore, the squeezing of the central portion of the low pressure air streams LP will cause a suction towards the central portion of the rotor 1, i.e., towards the turbulent flow area TA. This suction will suck an upper portion of the low pressure air streams LP from the vicinity of the upper disc 2 and to the turbulent flow area TA, as seen in FIG. 6. In a similar manner, a lower portion of the low pressure air streams LP will be sucked from the vicinity of the lower disc 6 towards the turbulent flow area TA, as is also shown in FIG. 6. This suction towards the turbulent flow area TA will substantially reduce the wear on the upper and lower discs 2, 6 and on the transitions between the discs 2, 6 and the tip holder 156.

Figure 7A:
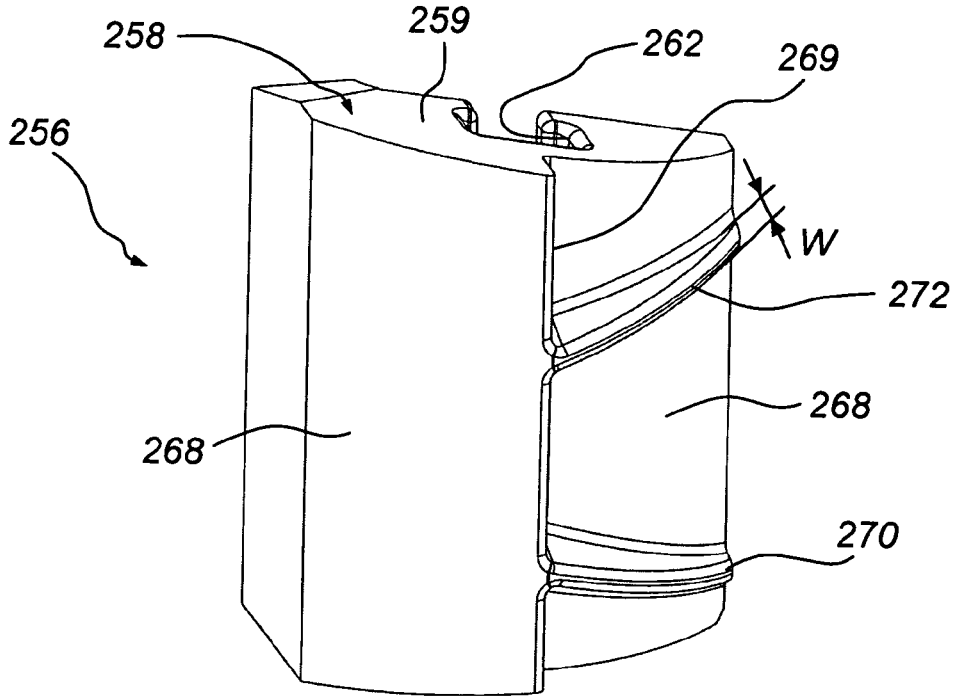
FIG. 7*a* is a three-dimensional view of a cavity wear plate.
Figure 7B:
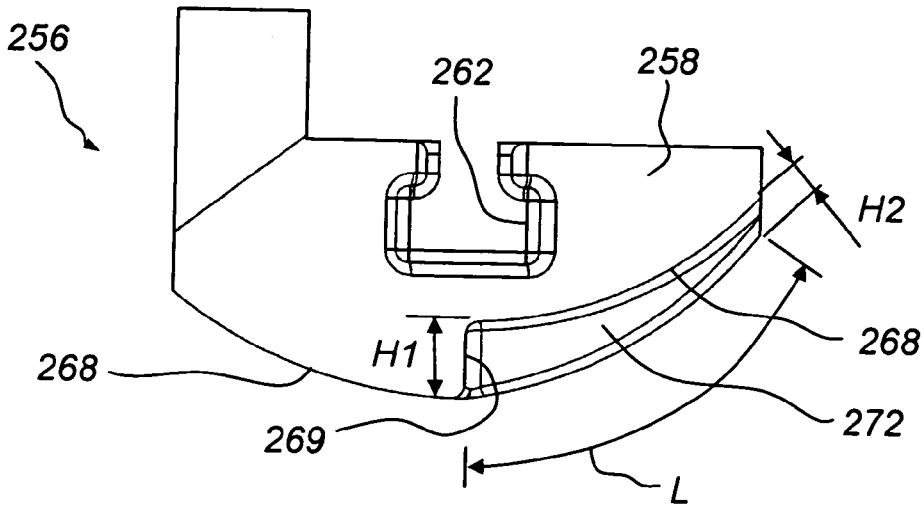
FIG. 7*b* is a top view of the cavity wear plate of FIG. 7*a*.
Figure 7C:
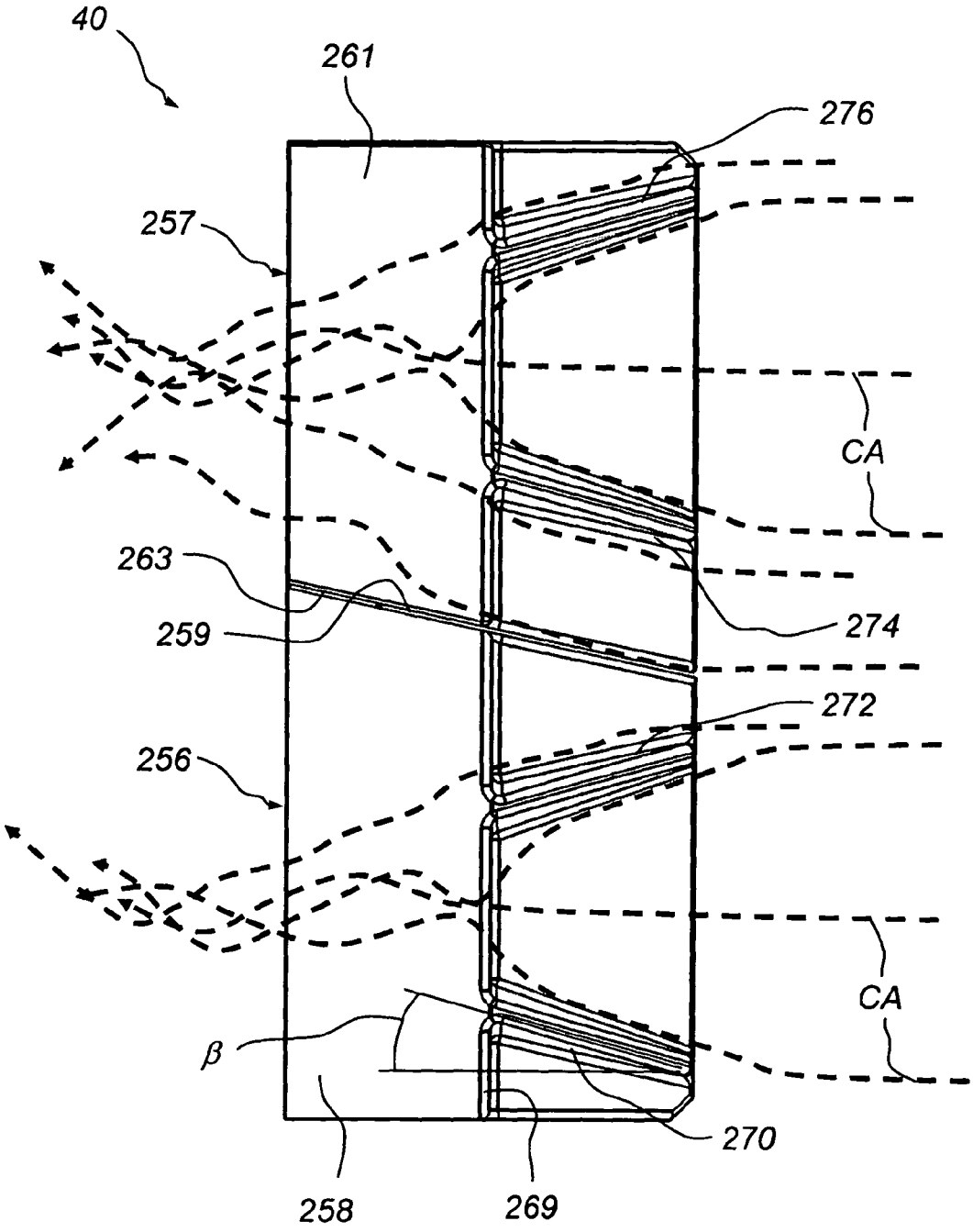
FIG. 7*c* is a side view of two cavity wear plates located adjacent to each other, and illustrates the function of the cavity wear plates.

FIG. 7*a* and 7*b* illustrate a third embodiment of a wear part in the form of a cavity wear plate 256. FIG. 7*c* illustrates the pair 40 of cavity wear plates also shown in FIG. 2 and FIG. 3, such pair 40 comprising the cavity wear plate 256 and a second cavity wear plate 257, which is complementary to the cavity wear plate 256.

The cavity wear plate 256 has a wear body 258 and holding means in the form of an elongated recess 262. By means of the recess 262 the cavity wear plate 256 can be mounted to the wall segment 24, by means of, e.g., bolts 265, which are indicated in FIG. 2.

Returning to FIG. 7*a* and 7*b*, the wear body 258 has a wear surface 268 which is located at the opposite side of the wear body 258 compared to the elongated recess 262. The wear surface 268 is adapted for contacting abrasive particles and dust contained in the dust laden low pressure air streams LP circulating around the rotor 1, as illustrated in FIG. 3. In particular, the wear surface 268 is adapted for contacting dust laden low pressure air streams denoted CA in FIG. 3 and flowing into the cavity 50. The wear surface 268 is provided with two ridges 270, 272. The ridges 270, 272 extend from a vertical shoulder 269, which is formed at the center of the wear surface 268, as shown in FIG. 7*a*, and over a portion of the wear surface 268, in a direction generally towards the center of the rotor 1, when the cavity wear plate 256 has been mounted on the rotor 1. FIG. 7*a* clearly illustrates that the ridges 270, 272 are not parallel to each other, but extend in different directions. The ridges 270 and 272 are straight, which is best shown in FIG. 7*c*, as seen from the top of the respective ridge, and extend away from each other, as seen from the vertical shoulder 269. The ridge 270 is inclined by an angle β of 30° to the horizontal plane, as seen in FIG. 7*c*. From FIG. 7*b* it is clear that the wear surface 268 has a curvature and that the ridge 272 follows the curvature of the wear surface 268.

As is illustrated in FIG. 7*b*, the ridge 272 has, adjacent to the vertical shoulder 269, a first height H1 above the wear surface 268. The ridge 272 has a second height H2 above the wear surface 268, at its opposite end. The height H1 is typically 10 mm, and the height H2 is typically 6 mm. The total length L of the ridge 272 is 65 mm. Furthermore, and as is best illustrated in FIG. 7*a*, the ridge 272 has a width W of about 4.5 mm. The ridges 270, 272 of the cavity wear plate 256 will serve to break up laminar flow patterns of dust laden low pressure air streams LP according to similar principles as described hereinbefore with reference to FIG. 6. In particular the ridges 270, 272 will be efficient in breaking up dust laden low pressure air streams CA flowing into the cavity 50, as illustrated by arrows in FIG. 7*c*. Typically the deflection of the dust laden low pressure air streams CA would correspond to the angle β, i.e., the deflection would be about 30°.

As can be seen from FIG. 7*c*, the pair 40 of cavity wear plates comprises a first cavity wear plate 256 and a second cavity wear plate 257, which is provided with ridges 274, 276, but which does not have identically the same design as the first cavity wear plate 256. The wear body 258 of the first cavity wear plate 256 has an inclined upper surface 259, which slopes downwards, as seen from the left to the right in FIG. 7*c*. The second cavity wear plate 257 has a wear body 261, which has an inclined lower surface 263, which slopes downwards, as seen from the left to the right in FIG. 7*c*. The respective inclined surfaces 259, 263 provides a sloping contact between the two cavity wear plates 256, 257. This sloping contact will assist in breaking up the laminar dust laden low pressure air streams CA as indicated in FIG. 7*c*, and will decrease the wear on the cavity wear plates 256, 257 themselves.

It will be appreciated that numerous modifications of the embodiments described above are possible within the scope of the appended claims.

Above it has been described that the ridges are either straight or shaped as arcs. It will be appreciated that other shapes may also be feasible, as well as combinations of shapes. For instance a ridge could be straight along one portion of its length, and shaped as an arc along another portion of its length.

The wear parts 56, 156, 256, 257 illustrated above all have two or four ridges. It will be appreciated that it is also possible to design a wear part with only one ridge, with three ridges, and with even more ridges. The number of ridges on the wear part can be determined based on the size of the wear part, whether the wear part is to be combined with other wear parts, e.g., to form a pair or a group of wear parts, in what position the wear part is to be located, etc.

The sizes of the ridges given above are examples. Preferred ranges as regards inclination, width, height and length of the ridges are indicated in the summary of the invention and in the claims. Again, the exact sizes of the ridges could be designed based on the location of ridge, the wear effect of the dust circulating inside the housing of the VSI-crusher, the required life of the wear part, etc. The inclination between at least a portion of the ridge and the horizontal plane is preferably about 20 to 70°.

The disclosures in Swedish patent application No. 0700983-0, from which this application claims priority, are incorporated herein by reference.

Although the present invention has been described in connection with preferred embodiments thereof, it will be appreciated by those skilled in the art that additions, deletions, modifications, and substitutions not specifically described may be made without department from the spirit and scope of the invention as defined in the appended claims.

The invention claimed is:

1. A wear part mounted on a vertical rotor wall of a rotor of a VSI-crusher, said rotor having a horizontal upper disc, and a horizontal lower disc, said vertical rotor wall connecting said horizontal upper disc to said horizontal lower disc, said wear part comprising:

a wear body having a wear surface adapted for contacting abrasive particles, the wear surface being provided with at least one ridge extending over at least a portion of said wear surface, said wear part being mounted to said vertical rotor wall such that at least a portion of the length of said ridge being inclined in relation to a horizontal plane.

2. The wear part according to claim 1, wherein said wear part is provided with at least two ridges.

3. The wear part according to claim 2, wherein said at least two ridges extend in different directions, at least for a portion of their respective lengths.

4. The wear part according to claim 1, wherein at least one ridge extends from a shoulder formed on said wear surface.

5. The wear part according to claim 4, wherein said at least one ridge has the form of an arc, as seen from the top of the ridge, along at least a portion of its length.

6. The wear part according to claim 4, wherein said at least one ridge is straight, as seen from the top of the ridge, along at least a portion of its length.

7. The wear part according to claim 4, wherein said wear surface is provided with a curvature, said at least one ridge following the curvature of said wear surface.

8. The wear part according to claim 4, wherein said at least one ridge extends, for at least a portion of its length, to a height of at least 3 mm from the wear surface.

9. The wear part according to claim 4, wherein said at least one ridge has a width, for at least a portion of its length, of 4-20 mm.

10. The wear part according to claim 4, wherein said at least one ridge has a total length of 20 to 200 mm.

11. The wear part according to claim 1, wherein said wear part is a cavity wear plate adapted for protecting a cavity formed in the vertical rotor wall, said wear surface comprising a shoulder being adapted for being located adjacent to the periphery of the rotor, said at least one ridge extending from said shoulder in a direction generally towards the center of the rotor, when said wear part has been mounted to said vertical rotor wall.

12. The wear part according to claim 1, wherein said at least one ridge for breaking up, during rotation of said rotor, horizontal dust laden air streams, which circulate around the rotor adjacent to said wear surface, by deflecting such air streams from the horizontal plane.

13. The wear part according to claim 12, wherein said horizontal dust laden air streams from the horizontal plane by way of said at least one ridge corresponds to a deflection, locally, of 20-70°.

14. A wear part for protecting a vertical rotor wall of a rotor of a VSI-crusher, said rotor having a horizontal upper disc, and a horizontal lower disc, said vertical rotor wall connecting said horizontal upper disc to said horizontal lower disc, said wear part comprising:

a wear body having a wear surface adapted for contacting abrasive particles, the wear surface being provided with at least one ridge extending over at least a portion of said wear surface, at least a portion of the length of said ridge being, when said wear part has been mounted to said vertical rotor wall, inclined in relation to a horizontal plane; and wherein said wear part is a tip holder comprising a wear body which holds a wear tip, said at least one ridge being located on said wear surface formed on said wear body, and extending generally from the location of said wear tip.

15. A wear part mounted on a vertical rotor wall of a rotor of a VSI-crusher, said rotor having a horizontal upper disc, and a horizontal lower disc, said vertical rotor wall connecting said horizontal upper disc to said horizontal lower disc, said wear part comprising:

a wear body having a wear surface adapted for contacting abrasive particles, the wear surface being provided with at least one ridge extending over at least a portion of said wear surface, said wear part being mounted to said vertical rotor wall such that at least a portion of the length of said ridge being inclined in relation to a horizontal plane, wherein said at least one ridge being separate and spaced from an additional ridge extending over the wear part.

* * * * *